US011691439B2

(12) United States Patent
Asada et al.

(10) Patent No.: US 11,691,439 B2
(45) Date of Patent: Jul. 4, 2023

(54) DRYER, PRINTER, AND BLOWER

(71) Applicants: Kohki Asada, Tokyo (JP); Kenji Nozawa, Kanagawa (JP); Genichiroh Kawamichi, Ibaraki (JP); Kazuaki Kamihara, Tokyo (JP); Ryusaku Hida, Kanagawa (JP)

(72) Inventors: Kohki Asada, Tokyo (JP); Kenji Nozawa, Kanagawa (JP); Genichiroh Kawamichi, Ibaraki (JP); Kazuaki Kamihara, Tokyo (JP); Ryusaku Hida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 7 days.

(21) Appl. No.: 17/564,215

(22) Filed: Dec. 29, 2021

(65) Prior Publication Data

US 2022/0242142 A1 Aug. 4, 2022

(30) Foreign Application Priority Data

Feb. 4, 2021 (JP) ..... 2021-016988

(51) Int. Cl.
*B41J 11/00* (2006.01)

(52) U.S. Cl.
CPC ..... *B41J 11/0022* (2021.01)

(58) Field of Classification Search
CPC ..... B41J 11/0022
See application file for complete search history.

(56) References Cited

U.S. PATENT DOCUMENTS

| | | | | |
|---|---|---|---|---|
| 5,896,154 | A * | 4/1999 | Mitani | B41J 11/0024 347/102 |
| 2016/0273832 | A1 | 9/2016 | Asada et al. | |
| 2017/0266987 | A1 | 9/2017 | Asada et al. | |
| 2017/0266988 | A1 | 9/2017 | Asada et al. | |
| 2017/0266989 | A1 | 9/2017 | Ogawa et al. | |
| 2017/0334218 | A1 | 11/2017 | Ogawa et al. | |
| 2018/0016106 | A1 | 1/2018 | Asada et al. | |
| 2018/0147878 | A1 | 5/2018 | Asada et al. | |
| 2018/0264852 | A1 | 9/2018 | Ohtake et al. | |
| 2019/0202215 | A1 | 7/2019 | Asada et al. | |
| 2019/0204767 | A1 | 7/2019 | Ishihara et al. | |
| 2020/0290383 | A1 | 9/2020 | Ishihara et al. | |
| 2021/0031542 | A1 | 2/2021 | Kamihara et al. | |
| 2021/0197584 | A1 | 7/2021 | Asada et al. | |
| 2021/0221149 | A1 | 7/2021 | Nakamura et al. | |
| 2021/0370692 | A1 | 12/2021 | Sawase et al. | |

FOREIGN PATENT DOCUMENTS

| | | |
|---|---|---|
| JP | 2016-107423 | 6/2016 |
| JP | 2019-166666 | 10/2019 |
| JP | 2020-158271 | 10/2020 |
| JP | 2021-107146 | 7/2021 |

* cited by examiner

*Primary Examiner* — Bradley W Thies
(74) *Attorney, Agent, or Firm* — Xsensus LLP

(57) ABSTRACT

A dryer includes a first airflow generator configured to generate a first airflow to be blown to a sheet conveyed in the blower, a second airflow generator configured to generate a second airflow to exhaust air in the blower outside the blower, and circuitry configured to control the first airflow generator and the second airflow generator to control a blowing amount of the first airflow and an exhaust amount of the second airflow according to a type of the sheet.

13 Claims, 6 Drawing Sheets

DRYER, PRINTER, AND BLOWER

CROSS-REFERENCE TO RELATED APPLICATIONS

This patent application is based on and claims priority pursuant to 35 U.S.C. § 119(a) to Japanese Patent Application No. 2021-016988, filed on Feb. 4, 2021, in the Japan Patent Office, the entire disclosure of which is hereby incorporated by reference herein.

BACKGROUND

Technical Field

Aspects of the present disclosure relate to a dryer, a printer, and a blower.

Related Art

A printer applies a liquid onto a print target such as a sheet. The printer includes a dryer such as a heater to heat the sheet on which the liquid is applied to accelerate drying of the liquid applied on the sheet.

A sheet conveyor includes a medium support surface, a conveyance unit, a blowing unit, an exhaust unit, and a rectifier. The medium support supports a medium. The conveyance unit conveys the medium in a medium conveyance direction. The blowing unit blows air to a conveyance path of the medium in the conveyance unit. The exhaust unit has an exhaust port disposed to face the medium support surface and exhausts air through the exhaust port. The rectifier regulates an airflow to the exhaust port. The rectifier is disposed in an exhaust space between the exhaust port and the medium supporting surface.

The rectifier has a structure in which a position corresponding to a medium non-passing region is opened in the exhaust space. The medium non-passing region is on an exterior in a medium width direction orthogonal to the medium conveyance direction of a medium passing region through which the medium passes.

Alternatively, the rectifier has a structure in which a position corresponding to a medium non-passing region is opened in the exhaust space.

SUMMARY

A dryer includes a first airflow generator configured to generate a first airflow to be blown to a sheet conveyed in the blower, a second airflow generator configured to generate a second airflow to exhaust air in the blower outside the blower, and circuitry configured to control the first airflow generator and the second airflow generator to control a blowing amount of the first airflow and an exhaust amount of the second airflow according to a type of the sheet.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
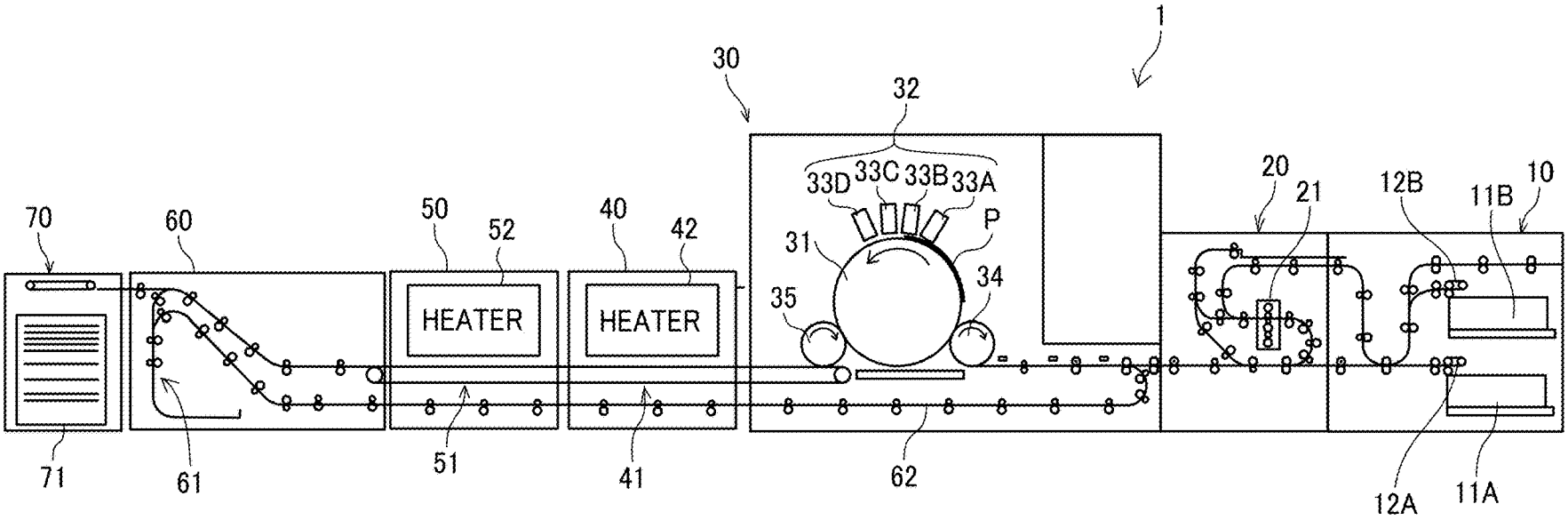
FIG. 1 is a schematic cross-sectional side view of a printer as a liquid discharge apparatus according to a first embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below. A printer 1 as a liquid discharge apparatus according to a first embodiment of the present disclosure is described with reference to FIGS. 1 and 2.

FIG. 1 is a schematic side view of the printer 1 according to the first embodiment.

Figure 2:
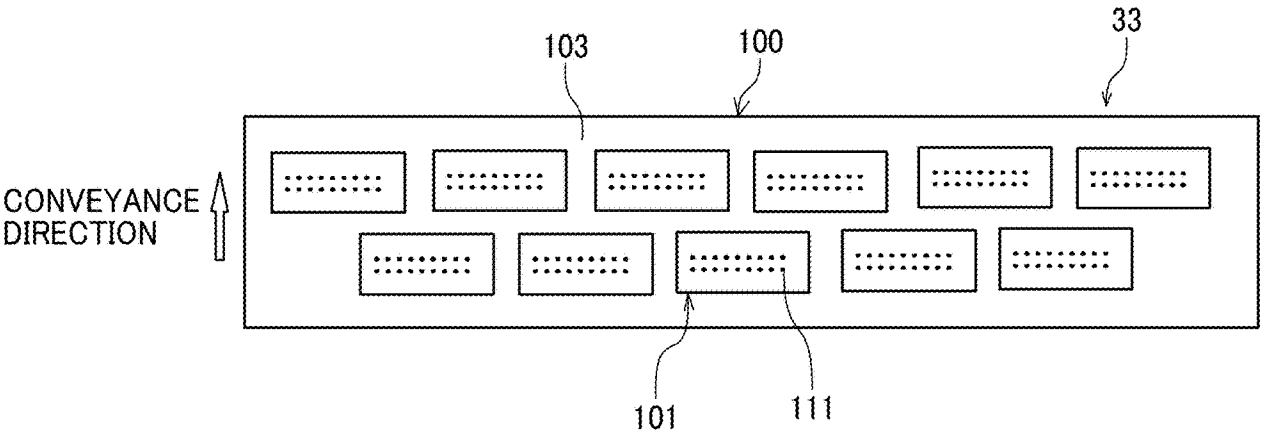
FIG. 2 is a plan view illustrating a discharging unit of the printer of FIG. 1.

FIG. 2 is a schematic plan view of a discharge unit 33 of the printer 1.

The printer 1 according to the first embodiment includes a loading unit 10 to load a sheet P into the printer 1, a pretreatment unit 20, a printing unit 30, a first dryer 40 and a second dryer 50, a reverse mechanism 60, and an ejection unit 70. The pretreatment unit 20 serves as a liquid applier to apply a pretreatment liquid onto the sheet P.

In the printer 1, the pretreatment unit 20 applies, as desired, a pretreatment liquid as an application liquid onto the sheet P fed (supplied) from the loading unit 10, the printing unit applies a desired liquid onto the sheet P to perform desired printing.

After the printer 1 dries the liquid adhering to the sheet P by the first dryer 40 and the second dryer 50, the printer 1 ejects the sheet P to the ejection unit 70 through the reverse mechanism 60 without printing on a back surface of the sheet P. The printer 1 may print on both sides of the sheet P via the reversing mechanism 60 after the printer 1 dries the liquid adhering to the sheet P by the dryer 500, and the printer 1 then ejects the sheet P to the ejection unit 70.

The loading unit 10 includes loading trays 11 (a lower loading tray 11A and an upper loading tray 11B) to accommodate multiple sheets P and feeding devices 12 (a feeding device 12A and a feeding device 12B) to separate and feed the multiple sheets P one by one from the loading trays 11. The loading unit 10 supplies the sheets P to the pretreatment unit 20.

The pretreatment unit 20 includes, e.g., a coater 21 as a treatment-liquid application unit that coats a printing surface of the sheet P with a treatment liquid having an effect of aggregation of ink particles to prevent bleed-through.

The printing unit 30 includes a drum 31 and a liquid discharge device 32. The drum 31 is a bearer (rotator) that bears the sheet P on a circumferential surface of the drum 31 and rotates. The liquid discharge device 32 discharges liquids toward the sheet P borne on the drum 31.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the first dryer 40.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes a plurality of suction holes dispersed on a surface of the drum 31. A suction unit generates suction airflows directed from desired suction holes of the drum 31 to an interior of the drum 31.

The sheet gripper of the drum 31 grips the leading end of the sheet P forwarded from the transfer cylinder 34 to the drum 31, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) to discharge liquids onto the sheet P as a liquid application device. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). Further, the liquid discharge device 32 may further include a discharge unit 33 to discharge a special liquid, that is, a liquid of spot color such as white, gold, or silver.

As illustrated in FIG. 2, for example, each of the discharge unit 33 includes a head module 100 including a full-line head. The head module 100 includes multiple liquid discharge heads 101 arranged in a staggered manner on a base 103. Each of the liquid discharge head 101 includes multiple nozzle arrays, and multiple nozzles 111 are arranged in each of the nozzle arrays. Hereinafter, the "liquid discharge head 101" is simply referred to as a "head 101".

A discharge operation of each of the discharge unit 33 of the liquid discharge device 32 is controlled by a drive signal corresponding to print data. When the sheet P borne on the drum 31 passes through a region facing the liquid discharge device 32, the liquids of respective colors are discharged from the discharge units 33 toward the sheet P, and an image corresponding to the print data is formed on the sheet P.

The first dryer 40 includes a heater 42 such as an infrared (IR) heater. The heater 42 of the first dryer 40 irradiates the sheet P, onto which the liquid has been applied, with infrared rays to heat and dry the sheet P conveyed by the conveyor 41. The second dryer 50 includes a heater 52 such as an ultraviolet (UV) ray irradiator. The heater 52 of the second dryer 50 irradiates the sheet P, to which the liquid has been applied, with infrared rays to heat and dry the sheet P passed through the first dryer 40 and conveyed by a conveyor 51. The conveyor 41 and the conveyor 51 may include a part of same conveyance mechanism.

The reverse mechanism 60 includes a reverse path 61 and a duplex path 62. The reverse path 61 reverses the sheet P that has passed through the first dryer 40 and the second dryer 50 to dry a first surface of the sheet P onto which the liquid is applied when the printer 1 performs a duplex printing. The duplex path 62 feeds the reversed sheet P back to upstream (right side in FIG. 1) of the transfer cylinder 34 of the printing unit 30. The reverse path 61 reverses the sheet P by switchback manner.

The ejection unit 70 includes an ejection tray 71 on which a plurality of sheets P is stacked. The multiple sheets P conveyed from the reverse mechanism 60 is sequentially stacked and held on the ejection tray 71.

The printer 1 in the first embodiment uses a cut sheet as the sheet P However, the printer 1 according to the first embodiment can also be applied to an apparatus using a continuous medium (web) such as continuous paper or roll paper, an apparatus using a sheet material such as wallpaper, and the like.

A dryer 500 including a blower 505 according to the first embodiment of the present disclosure is described with reference to FIGS. 3 and 4.

Figure 3:
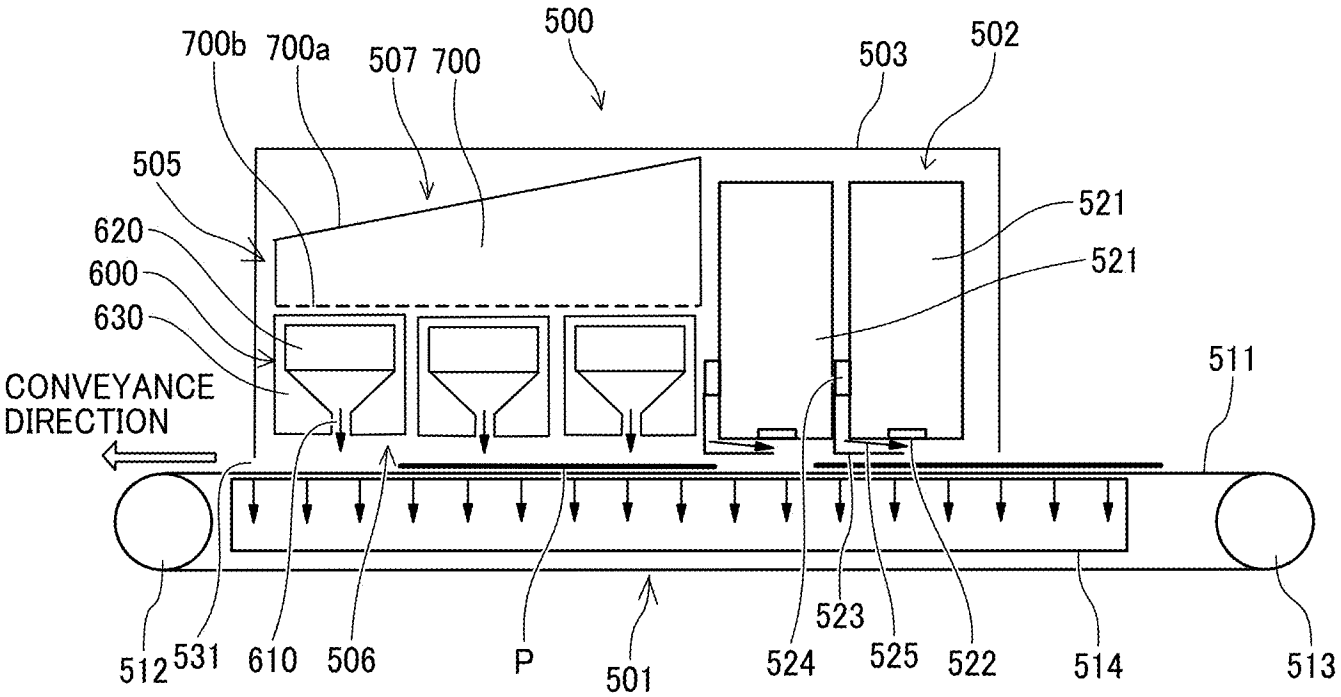
FIG. 3 is a schematic cross-sectional side view of a dryer according to a first embodiment of the present disclosure.

FIG. 3 is a schematic cross-sectional side view of the dryer 500 according to the first embodiment of the present disclosure.

Figure 4:
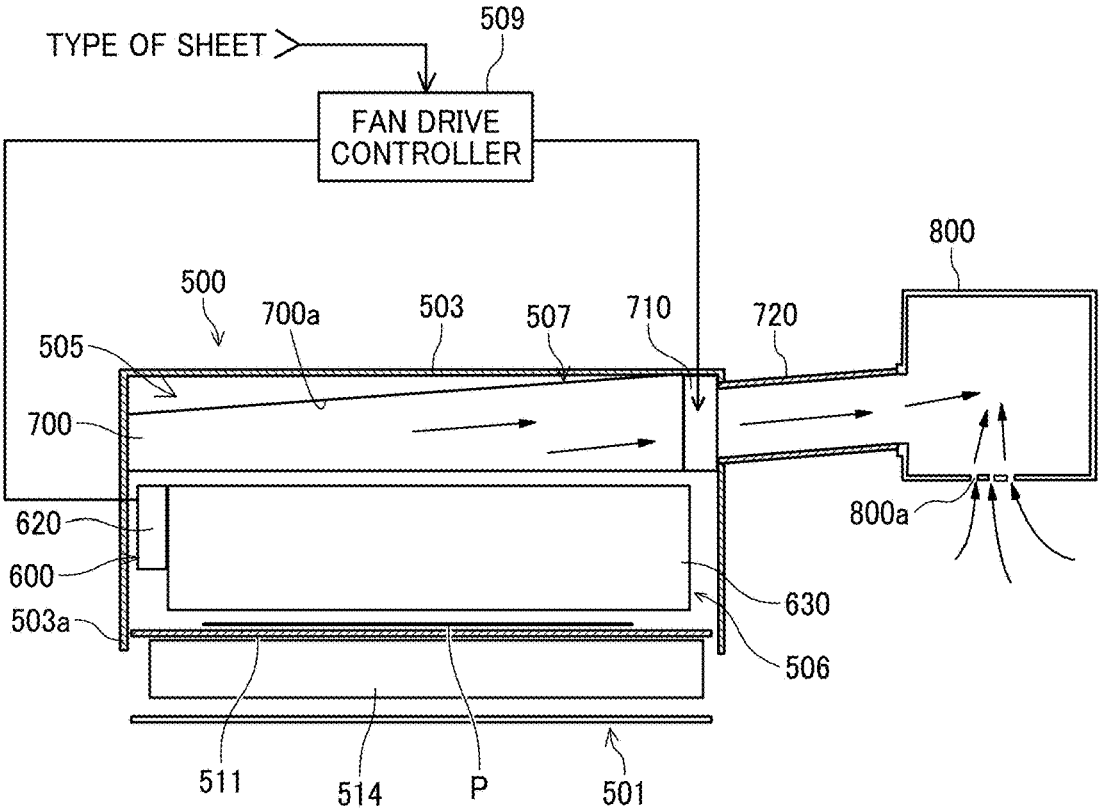
FIG. 4 is a schematic cross-sectional front view of the dryer of FIG. 3.

FIG. 4 is a schematic cross-sectional front view of the dryer 500 according to the first embodiment of the present disclosure.

The dryer 500 includes a conveyance mechanism 501 as a conveyor, an ultraviolet irradiator 502 as the heater 52, a blowing device 506, an exhaust 507, and a fan drive controller 509 (see FIG. 4). The dryer 500 configures the second dryer 50. The blowing device 506, the exhaust 507, and the fan drive controller 509 configure a blower 505 according to the first embodiment.

The conveyance mechanism 501 includes a conveyance belt 511 that bears and conveys the sheet P. The conveyance belt 511 is an endless belt wound (stretched) between a drive roller 512 and a driven roller 513. The conveyance belt 511 circulates (rotates) to move the sheet P. The conveyance mechanism 501 according to the first embodiment includes a mechanism to convey the sheet P from the printing unit 30 to the reverse mechanism 60 as illustrated in FIG. 1. The conveyance mechanism 501 includes the conveyor 41 and the conveyor 51 in FIG. 1.

The conveyance belt 511 is a belt that includes multiple openings from which an air is sucked by a suction chamber 514 disposed inside the conveyance belt 511. The conveyance belt 511 may be, for example, a mesh belt, a flat belt having a suction hole, or the like. The suction chamber 514 includes a suction blower, a fan, or the like to sucks the air through the multiple openings in the conveyance belt 511 to attract the sheet P to the conveyance belt 511. The conveyance mechanism 501 (conveyor) is not limited to the conveyor that uses suction method to attract the sheet P as described above. For example, the conveyance mechanism 501 (conveyor) may convey the sheet P by an electrostatic attraction method, a gripping method using a gripper, or the like.

The ultraviolet irradiator 502 includes multiple (two in FIG. 3) ultraviolet irradiators 521 disposed along a conveyance direction of the sheet P indicated by arrow in FIG. 3 in a housing 503. The ultraviolet irradiators 521 irradiates the sheet P conveyed by the conveyance mechanism 501 with ultraviolet rays to heat the sheet P.

A channel plate 523 is disposed between the conveyance belt 511 of the conveyance mechanism 501 as the conveyor and an irradiation surface 522 of the ultraviolet irradiator 521 as a heater.

The channel plate 523 may be, for example, a general metal plate, a reflector to return a light reflected from the sheet P to the sheet P again, or the like. The channel plate 523 is disposed at a position close to the irradiation surface 522 to a degree in which the channel plate 523 does not block an ultraviolet light (UV light) emitted from the irradiation surface 522 of the ultraviolet irradiator 521. An airflow generator 524 is disposed downstream of each of the ultraviolet irradiator 521 to generate an airflow 525 along the irradiation surface 522.

The housing 503 is an exterior cover (unit exterior cover) of the dryer 500. As illustrated in FIG. 3, the housing 503 is arranged to have a gap 531 (opening) with the conveyance belt 511 in a vertical direction, and the gap 531 is formed along the conveyance direction of the sheet P. As illustrated in FIG. 4, the housing 503 includes an extension portion 503*a* extended lower than the conveyance belt 511 in a vertical (height) direction perpendicular to the conveyance direction of the sheet P.

The blowing device 506 includes multiple blowing units 600 configured to blow air toward the sheet P conveyed by the conveyance belt 511. The blowing unit 600 includes a channel member 630 and a first airflow generator 620. The channel member 630 has a blowing port 610 from which an air is blown toward the conveyance belt 511. The first airflow generator 620 includes a fan to generate an airflow blown from the blowing port 610.

The exhaust 507 includes an exhaust duct 700 and a second airflow generator 710 (see FIG. 4). The exhaust duct 700 is disposed above the multiple blowing units 600. The second airflow generator 710 is disposed at a downstream end of the exhaust duct 700 in an exhaust direction of the second airflow. Thus, the exhaust duct 700 includes the second airflow generator 710 at a downstream end thereof in an exhaust direction of the second airflow. The exhaust duct 700 has an inclined top surface 700*a*, a height of which increases toward the second airflow generator 710 in the exhaust direction.

Figure 5:
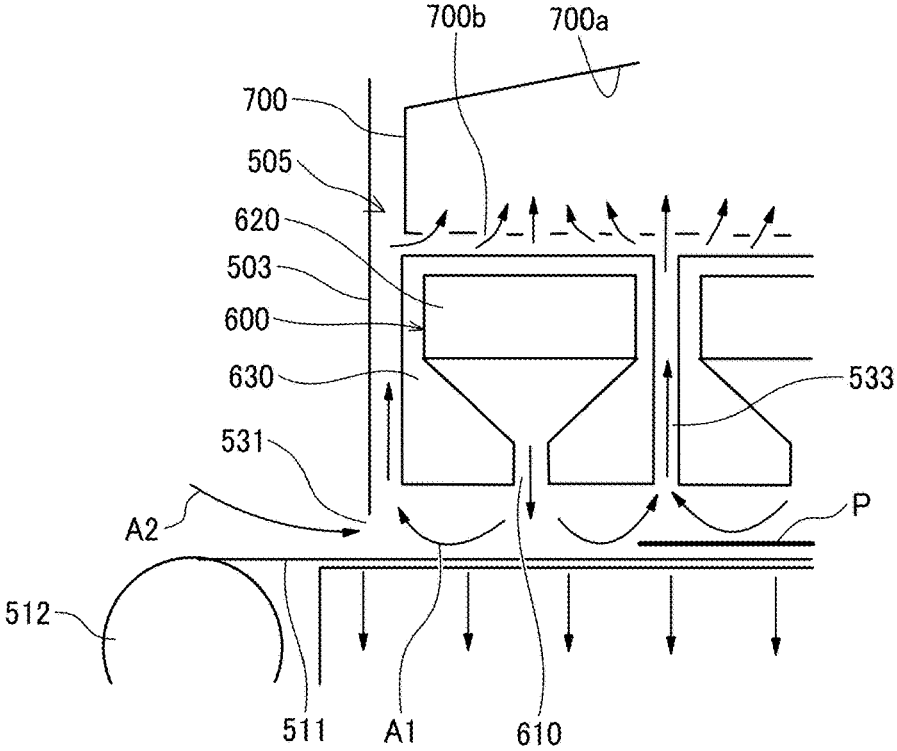
FIG. 5 is a schematic cross-sectional front view of the dryer illustrating an airflow in the dryer to describe an effect of the first embodiment.

The second airflow generator 710 includes a fan disposed on an outlet of the exhaust duct 700. The exhaust duct 700 has a top surface 700*a* and an air intake port 700*b* (see FIG. 5). The top surface 700*a* is inclined so that a height of the top surface increases toward the second airflow generator 710 in the exhaust direction as indicated by arrow in FIG. 4 (rightward direction in FIG. 4). The air intake port 700*b* is disposed on a lower surface of the exhaust duct 700 as illustrated in FIG. 5.

The dryer 500 includes an exhaust duct 720 serving as a first exhaust path on a downstream of the second airflow generator 710. Air exhausted through the exhaust duct 700 passes through the exhaust duct 720 (first exhaust path). The exhaust duct 720 is coupled to a facility piping 800 (facility duct) as a second exhaust path. This piping configuration is referred to as an "indirect piping configuration".

The facility piping 800 is a piping between the printer 1 in a building in which the printer 1 is installed and an air-conditioning duct exterior of the building. The facility piping 800 has an air intake port 800*a* to take in air outside the printer 1. The facility piping 800 forms an exhaust path in which an exhaust air (second airflow) that has passed through the exhaust duct 720 and the air taken in from the outside of the blower 505 (printer 1) converges. The facility piping 800 is used to exhaust air at a constant exhaust rate by an exhaust facility.

Thus, the second airflow that has passed through the first exhaust path (exhaust duct 720) and the air outside the blower 505 converges in the second exhaust path (facility piping 800). Thus, the second exhaust path (facility piping 800) includes the air intake port 800*a* configured to take in air outside the blower 505, and to converge the air outside the blower 505 with the second airflow that has passed through the first exhaust path (exhaust duct 720).

The fan drive controller 509 inputs type information of the sheet P. The fan drive controller 509 controls a driving of the first airflow generator 620 of the blowing unit 600 according to a type of the sheet P to control a blowing amount of a first airflow of the first airflow generator 620. The fan drive controller 509 controls a driving of the second airflow generator 710 to control an exhaust amount of a second airflow of the second airflow generator 710.

Next, the dryer 500 of the printer 1 is described with reference also to FIG. 5.

FIG. 5 is a schematic cross-sectional front view of the dryer 500 illustrating an airflow in the dryer 500 to describe an effect of the first embodiment.

In the printer 1, the sheet P onto which a liquid has been applied in the printing unit is sequentially conveyed to the first dryer 40 and the second dryer 50 by the conveyance belt 511. At this time in which the sheet P is conveyed to the first dryer 40 and the second dryer 50, the sheet P is heated by the ultraviolet irradiator 521 of the first dryer 40 and the second dryer 50 so that vapor floats on a surface of the sheet P.

In response to the vapor floating on the surface of the sheet P, the first airflow generator 620 of the blowing unit 600 generates a blowing airflow blown from the blowing port 610 onto the sheet P. As a result, the vapor floating near the surface of the sheet P is blown off by the airflow blown by the first airflow generator 620.

On the other hand, the second airflow generator 710 of the exhaust 507 is rotationally driven to generate an airflow 533 to exhaust an air outside the printer 1. As indicated by an arrow in FIG. 5, air inside the housing 503 (inside the printer 1) is taken into the exhaust duct 700 from the air intake port 700*b* (see FIG. 5) of the exhaust duct 700.

That is, the exhaust duct 700 takes in an air A1 that is blown onto the sheet P by the blowing unit 600 and rises (see FIG. 5). Further, the exhaust duct 700 also takes in an air A2 sucked into the housing 503 of the printer 1 from the gap 531 (opening) through which the sheet P passes between the housing 503 and the conveyance belt 511.

Then, the air taken into the exhaust duct 700 flows to the facility piping 800 via the exhaust duct 720 by an exhaust airflow generated by the second airflow generator 710 (see FIG. 5). The air flowing to the facility piping 800 is merged with external air in the facility piping 800 and discharged outside the printer 1 at an installation place of the printer 1.

The facility piping 800 in the indirect piping configuration merges air from the exhaust duct 720 and air outside the printer 1 and exhausts the merged air outside the printer 1. Therefore, when the exhaust amount of an exhaust facility communicating with the facility piping 800 is constant, an intake amount of an external air decreases when the exhaust amount from the exhaust duct 720, and the intake amount of the external air when the exhaust amount from the exhaust duct 720 decreases.

In the above manner, the exhaust amount by the facility piping 800 is not affected by an increase or a decrease in the exhaust amount by the second airflow generator 710. Thus, the blower 505 can control the second airflow generator 710 in the printer 1 to change the exhaust amount by the facility piping 800.

Next, floating of the sheet P due to an exhaust air in the housing 503 of the dryer 500 is described below.

In the printer 1, the first dryer 40, the second dryer 50, and the reverse mechanism 60 are partitioned by separate housings (exterior covers) and coupled to each other. Further, a gap 531 (opening) is formed between the housing 503 of the dryer 500 and the conveyance belt 511 so that the sheet P, conveyed by the conveyance belt 511 as a conveyor, becomes movable. The dryer 500 configures the second dryer 50.

The blowing amount of air blown to the sheet P by each blowing unit 600 of the blowing device 506 varies according to a type of the sheet P.

The dryer 500 may have a direct piping configuration in which the exhaust duct 700 is directly coupled to the exhaust facility, and the dryer 500 may exhaust the air using the exhaust facility. In the direct piping configuration, a flow rate of the exhaust amount of the exhaust facility is set larger than a flow rate of the maximum blowing amount so that the blower 505 exhausts air in the printer 1 even when air is blown by the first airflow generators 620 of all blowing units 600.

When the blowing amount of the blowing unit 600 is set to be smaller than the maximum blowing amount according to the type of the sheet P, the exhaust amount of the exhaust facility becomes larger than the blowing amount of the blowing unit 600.

When the exhaust amount of the exhaust facility becomes larger than the blowing amount of air blown onto the sheet P as described above, the air A2 (outside air) sucked from an exterior of the housing 503 of the dryer 500 through the gap 531 (opening). Then, a leading end of the sheet P is rolled up and lifted up by a suction airflow sucked from the gap 531 (opening) so that a conveyance stability is impaired.

Therefore, the dryer 500 according to the first embodiment includes the second airflow generator 710 in the exhaust duct 700. The fan drive controller 509 controls the exhaust amount of the second airflow generator 710 according to the type of sheet P.

Therefore, the fan drive controller 509 may control the blowing amount of the first airflow generator 620 and the exhaust amount of the second airflow generator 710 of each blowing unit 600 of the blowing device 506 to be substantially the same (including the same).

The fan drive controller 509 (circuitry) is configured to control the first airflow generator 620 and the second airflow generator 710 to control the exhaust amount of the second airflow generated by the second airflow generator 710 to be equal to the blowing amount of the first airflow generated by the first airflow generator 620.

Alternatively, the fan drive controller 509 may control the exhaust amount of the second airflow generator 710 to be slightly larger than the blowing amount of the first airflow generator 620.

Thus, the fan drive controller 509 may control the exhaust amount of the second airflow to be larger than the blowing amount of the first airflow by a predetermined amount. As an example of the predetermined amount, for example, a difference between an outflow rate of the second airflow generated by the second airflow generator 710 and an inflow rate of the first airflow rate generated by the first airflow generator 620 is larger than 0.5 $m^3$/min and equal to or less than 2.0 $m^3$/min as illustrated in FIG. 5.

The fan drive controller 509 may control a ratio (balance) between the outflow rate of the second airflow generated by the second airflow generator 710 and the inflow rate of the first airflow rate generated by the first airflow generator 620 to be from 1.0 to 2.0, preferably from 1.2 to 1.6.

As a result, the blower 505 can reduce an airflow flowing into the housing 503 from the gap 531 (opening) of the dryer 500 to reduce fluttering of the sheet P. As a result, the conveyance stability is not impaired by fluttering of the sheet P.

Next, a relation between the blowing amount and the exhaust amount in a Comparative Example 1 and the first embodiment is described below with reference to FIG. 6. The blowing amount is synonymous with a flow rate of the blowing air (inflow rate). The exhaust amount is synonymous with a flow rate of an exhaust air (outflow rate). The dryer 500 in the first embodiment has the indirect piping configuration and includes the second airflow generator 710. The Comparative Example 1 has the direct piping configuration.

Figure 6:
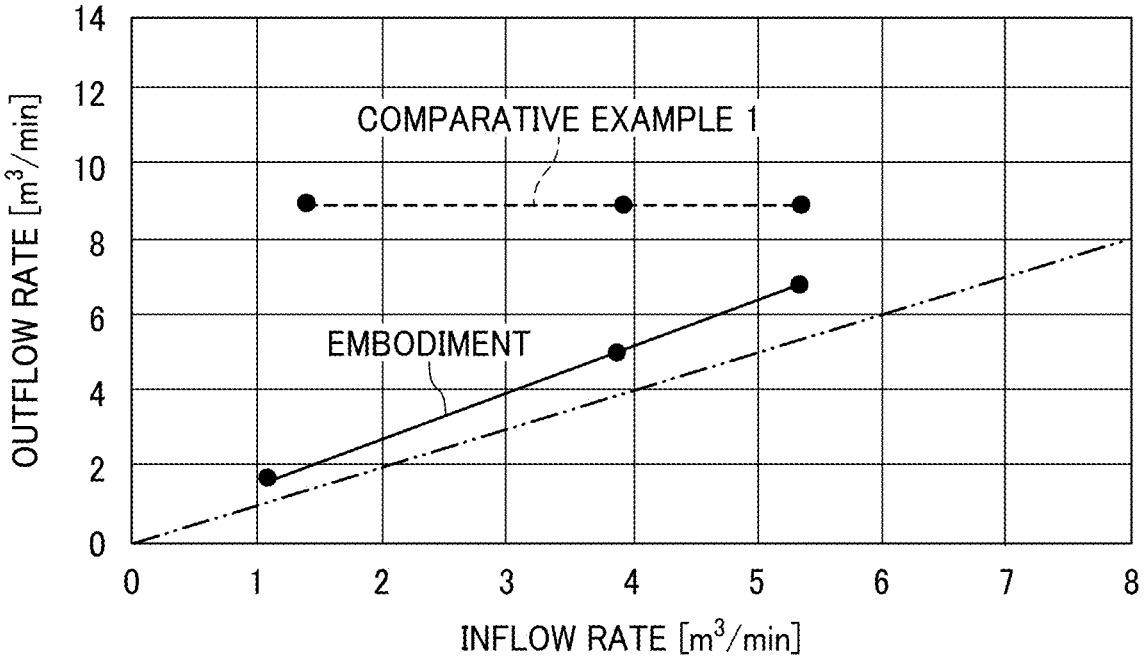
FIG. 6 is a graph illustrating a relation between a blowing amount and an exhaust amount in a Comparative Example 1 and the first embodiment.

FIG. 6 is a graph illustrating the above relation.

In FIG. 6, a horizontal axis represents a flow rate of air blown by the first airflow generator 620 into the dryer 500 (inflow rate) and a vertical axis represents a flow rate of the exhaust air passing through the second airflow generator 710 (outflow rate).

When the flow rate of the blown air (inflow rate) by the first airflow generator 620 is changed as indicated by a virtual line (chain double-dashed line) in FIG. 6, the fan drive controller 509 controls the second airflow generator 710 in the indirect piping configuration so that the inflow rate and the outflow rate of the dryer 500 become the same as indicated by a solid line in FIG. 6.

In other words, the fan drive controller 509 controls the first airflow generator 620 and the second airflow generator 710 to control the inflow rate of the first airflow generated by the first airflow generator 620 to be substantially equal to the outflow rate of the second airflow generated by the second airflow generator 710.

Thus, the fan drive controller 509 controls the first airflow generator 620 and the second airflow generator 710 to control a balance (ratio) between the inflow rate of the first airflow generated by the first airflow generator 620 and the outflow rate of the second airflow generated by the second airflow generator 710 to be substantially constant.

Therefore, the fan drive controller 509 controls the first airflow generator 620 and the second airflow generator 710 to increase the outflow rate of the second airflow generated by the second airflow generator 710 according to an increase in the inflow rate of the first airflow generated by the first airflow generator 620.

On the other hand, if the exhaust flow rate of the exhaust facility is made constant in the direct piping configuration, the outflow flow rate may not be controlled with respect to the flow rate of the air flowing into the dryer 500. Thus, the outflow rate of the Comparative Example 1 becomes constant regardless of the inflow rate, and the air in the dryer 500 is exhaust at a flow rate equal to or greater than the inflow rate as indicated by the broken line in FIG. 6.

In the above case, the exhaust flow rate is larger than the blowing flow rate. Thus, a large amount of air is sucked from the gap 531 of the dryer 500 so that the fluttering of the sheet P occurs as described above.

Next, a relation between a balance (ratio) between the exhaust flow rate and the blowing flow rate, and a flow velocity of the airflow (wind speed of the inflow airflow) flowing in from the gap 531 in the present embodiment and the Comparative Example 1 is described below with reference to FIG. 7.

Figure 7:
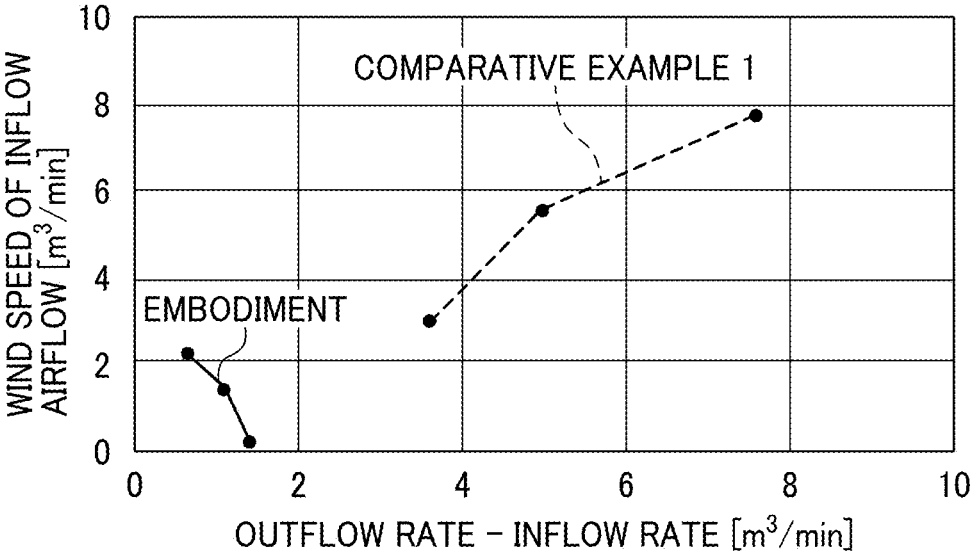
FIG. 7 is a graph illustrating a relation between a balance between an exhaust flow rate and a blowing flow rate, and a flow velocity of an airflow flowing in from an opening (wind speed of the inflow airflow) in the first embodiment and the Comparative Example 1.

FIG. 7 is a graph illustrating the above relation.

In FIG. 7, the horizontal axis represents a balance (ratio) between the exhaust flow rate and the blowing flow rate in the dryer 500, and the vertical axis represents a wind speed of the inflow airflow at that time. The balance (ratio) between the exhaust flow rate and the blowing flow rate is calculated by a difference between the exhaust flow rate (outflow rate) and the blowing flow rate (inflow rate), that is, a deduction of the blowing flow rate (inflow rate) from the exhaust flow rate (outflow rate) expressed by exhaust flow rate (outflow rate)—blowing flow rate (inflow rate).

In the dryer 500 according the first embodiment in which the second airflow generator 710 is controlled in the indirect piping configuration, the maximum wind speed is approximately 2 m/s as indicated by the solid line. On the other hand, the wind speed of the inflow airflow is as high as about 8 m/s in the direct piping configuration of the Comparative Example 1.

Thus, the fan drive controller 509 controls the first airflow generator 620 and the second airflow generator 710 to control the deduction of the blowing flow rate (inflow rate) from the exhaust flow rate (outflow rate) to be lower than 2 $m^3$/min as illustrated in FIG. 7.

Thus, the dryer 500 according to the first embodiment can reduce fluttering of the sheet P.

The dryer 500 according to a second embodiment of the present disclosure is described with reference to FIG. 8.

Figure 8:
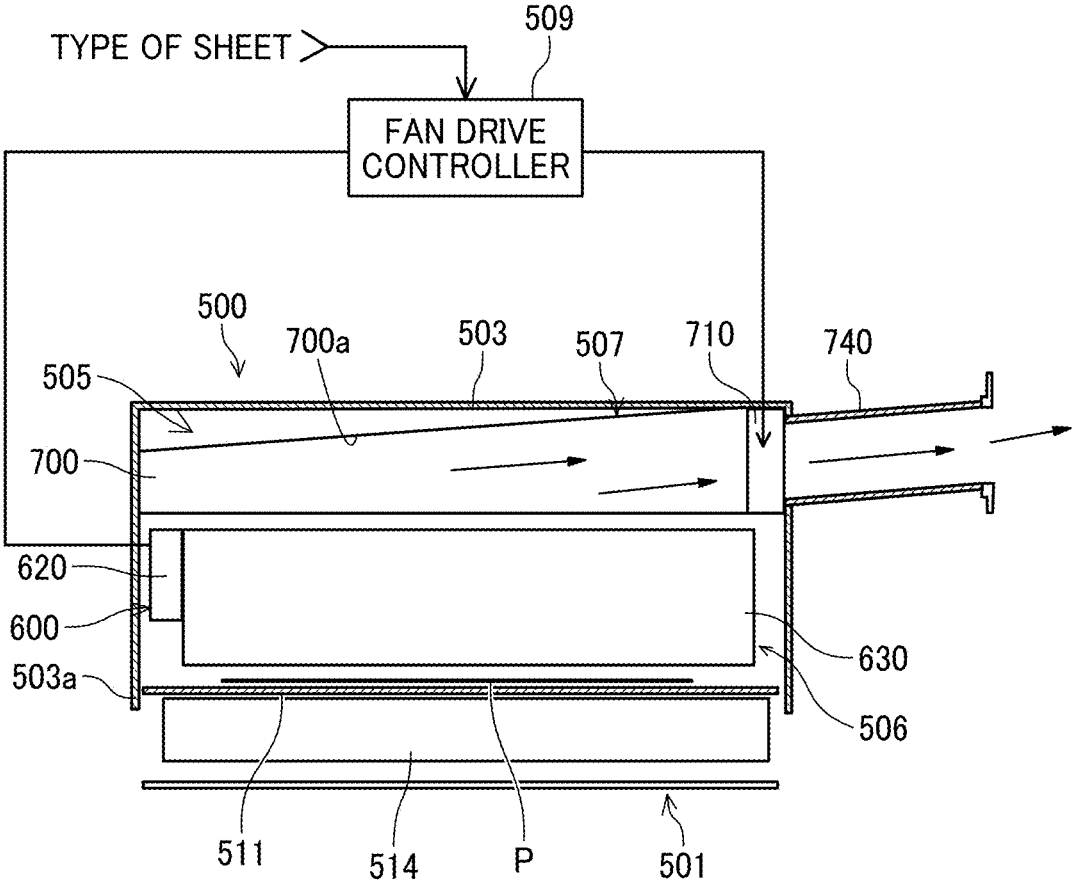
FIG. 8 is a schematic cross-sectional front view of the dryer according to a second embodiment of the present disclosure.

FIG. 8 is a schematic cross-sectional front view of the dryer 500 according to the second embodiment of the present disclosure.

The dryer 500 according to the second embodiment includes an exhaust duct 740 on a downstream of the second airflow generator 710. The exhaust duct 740 communicates with air outside the dryer 500. The dryer 500 according to the second embodiment does not include the facility piping 800.

In the dryer 500 according to the second embodiment as well, the fan drive controller 509 controls the blowing amount of the first airflow generator 620 and the exhaust amount of the second airflow generator 710 of the blowing unit 600 according to the sheet type.

Therefore, the fan drive controller 509 may control the blowing amount of the first airflow generator 620 and the exhaust amount of the second airflow generator 710 of each blowing unit 600 of the blowing device 506 to be substantially the same (including the same). Alternatively, the fan drive controller 509 may control the exhaust amount of the second airflow generator 710 to be slightly larger than the blowing amount of the first airflow generator 620.

Thus, the blower 505 can reduce an airflow flowing into the housing 503 from the gap 531 (opening) of the dryer 500 to reduce fluttering of the sheet P. Thus, the conveyance stability is not impaired by fluttering of the sheet P.

Next, the dryer 500 according to a third embodiment of the present disclosure is described with reference to FIGS. 9 and 10.

Figure 9:
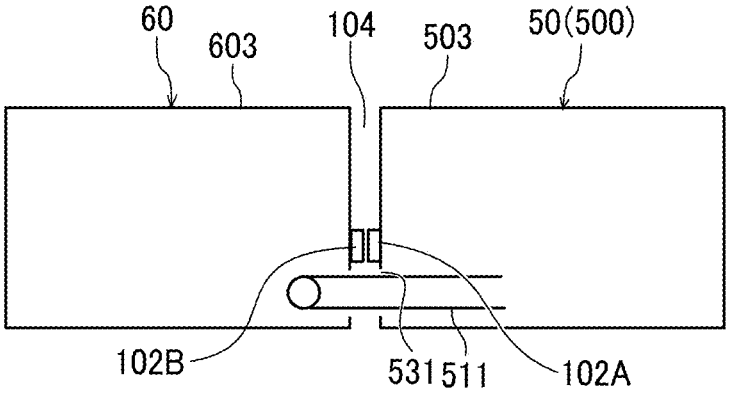
FIG. 9 is a schematic cross-sectional side view of a part of the printer illustrating the dryer according to a third embodiment.

FIG. 9 is a schematic cross-sectional side view of a part of the printer 1 illustrating the dryer 500 according to the third embodiment.

Figure 10:
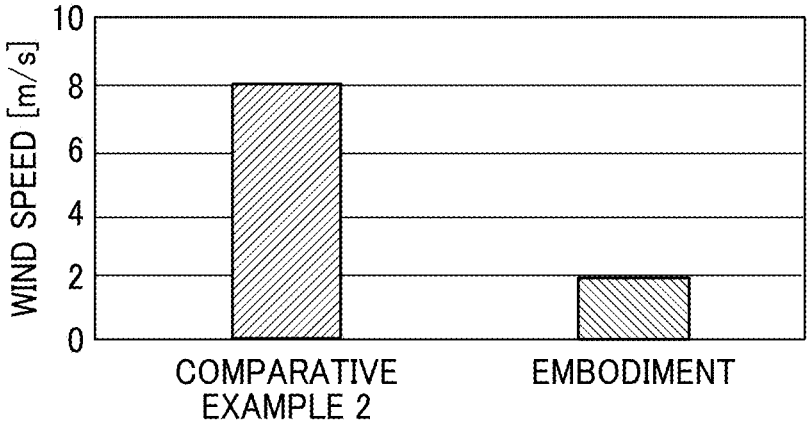
FIG. 10 is a graph illustrating an effect of the dryer according to the third embodiment.

FIG. 10 is a graph illustrating an effect of the dryer 500 according to the third embodiment.

In the dryer 500 according to the third embodiment as well, the reverse mechanism 60 is disposed adjacent to the second dryer 50 of the dryer 500. Thus, the reverse mechanism 60 serves as an adjacent device of the second dryer 50 of the dryer 500. The housing 503 of the dryer 500 and the housing 603 of the reverse mechanism 60 are arranged side by side with a gap 104 between the housing 503 and the housing 603.

Therefore, the housing 503 of the dryer 500 and the housing 603 of the reverse mechanism 60 respectively include flow rectifiers 102 (102A and 102B) partially narrowing the gap 104. Here, one of the flow rectifiers 102A and 102B may be used.

With such a configuration, the blower 505 can reduce the wind speed of the inflow airflow from the gap 531 of the dryer 500. For example, as illustrated in FIG. 10, the wind speed of the inflow airflow is approximately 8 m/s in a Comparative Example 2 that does not include the flow rectifier 102, whereas the wind speed of the inflow airflow is reduced to approximately 2 m/s in the dryer 500 according to the third embodiment that includes the flow rectifier 102. The flow rectifier 102 may be a plate.

Thus, the dryer 500 according to the third embodiment can further reduce the fluttering of the sheet P.

Next, the dryer 500 according to a fourth embodiment of the present disclosure is described with reference to FIG. 11.

Figure 11:
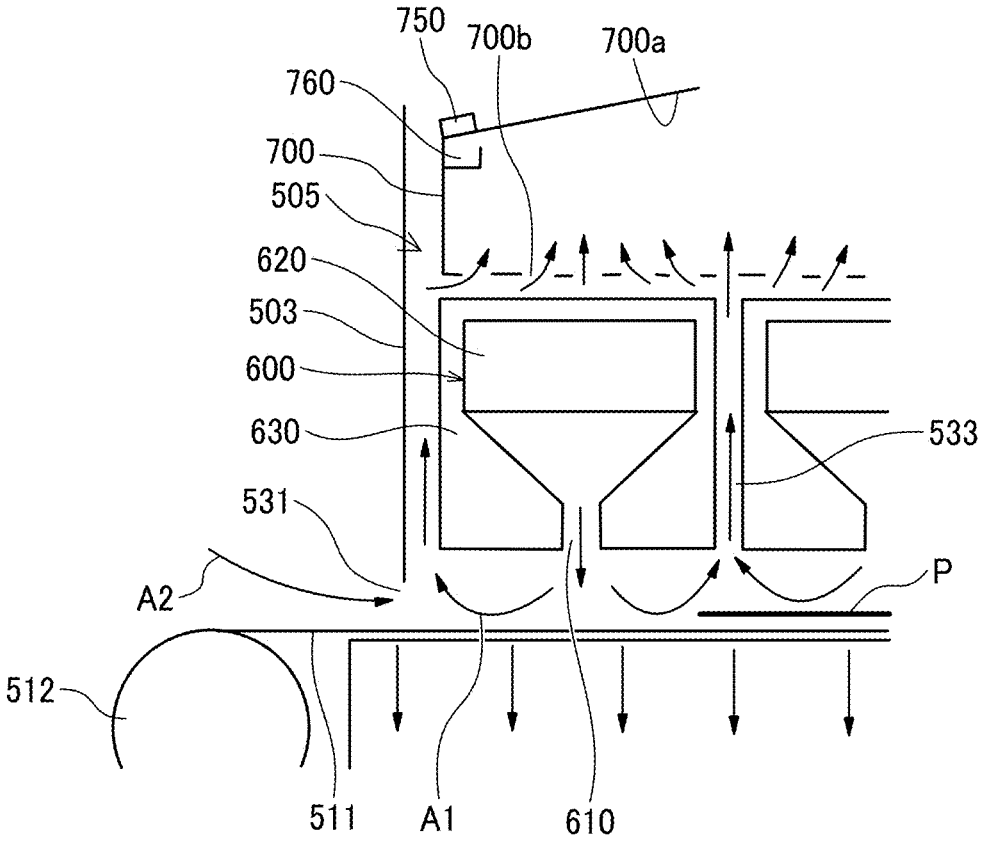
FIG. 11 is a schematic cross-sectional side view of the dryer according to a fourth embodiment of the present disclosure.

FIG. 11 is a schematic cross-sectional side view of the dryer 500 according to the fourth embodiment of the present disclosure.

The dryer 500 according to the fourth embodiment includes a cooler 750 as a cooler attached to an outer surface of a top surface 700*a*. The top surface 700*a* forms an inclined surface of the exhaust duct 700. Further, the dryer 500 includes a receiver 760 inside the exhaust duct 700. The receiver 760 receives condensation cooled by the cooler 750. The receiver 760 is disposed below the lowest point of the top surface 700*a* serving as the inclined surface of the exhaust duct 700.

With such a configuration, the condensation is cooled by the cooler 750, slides along the inclined top surface 700*a* of the exhaust duct 700, and falls into the receiver 760. A bottom surface of the receiver 760 is inclined such that a height of the bottom surface of the receiver 760 gradually decreases toward a rear end of the dryer 500. Thus, the condensation falling into the receiver 760 can be discharged to a condensation collection tank.

The dryer 500 may include multiple coolers 750 on the inclined top surface 700*a* of the exhaust duct 700. The dryer 500 may include a heater serving as a heating member instead of the cooler 750. Thus, the cooler 750 in FIG. 11 may be the heater.

As described above, when the dryer 500 exhausts vapor generated by drying the sheet P by the dryer 500, air flows into the dryer 500 from the gap 531 through which the sheet P passes, and the sheet P may flutter by the inflow airflow. The dryer 500 according to the above embodiments can reduce flattering of the sheet P and maintain conveyance stability.

In the present embodiments, a "liquid" discharged from the head is not particularly limited as long as the liquid has a viscosity and surface tension of degrees dischargeable from the head. Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials to which liquid can adhere, but also apparatuses to discharge a liquid toward gas or into a liquid.

The "liquid discharge apparatus" may include units to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can adhere" represents a material on which liquid is at least temporarily adhered, a material on which liquid is adhered and fixed, or a material into which liquid is adhered to permeate.

Examples of the "material on which liquid can adhere" include recording media, such as paper sheet, recording paper, recording sheet of paper, film, and cloth, electronic component, such as electronic substrate and piezoelectric element, and media, such as powder layer, organ model, and testing cell.

The "material on which liquid can adhere" includes any material on which liquid adheres unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Each of the functions of the described embodiments such as the fan drive controller 509 may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

The invention claimed is:

1. A dryer comprising:

a first airflow generator configured to generate a first airflow to be blown to a sheet conveyed in the blower;

a second airflow generator configured to generate a second airflow to exhaust air in the blower outside the blower; and circuitry configured to control the first airflow generator and the second airflow generator to control a blowing amount of the first airflow and an exhaust amount of the second airflow according to a type of the sheet.

2. The dryer according to claim 1, further comprising:

a first exhaust path downstream of the second airflow generator; and a second exhaust path coupled to the first exhaust path, wherein the second exhaust path includes an air intake port configured to take in air outside the blower, and to converge the air outside the blower with the second airflow that has passed through the first exhaust path.

3. The dryer according to claim 1, further comprising:

a flow rectifier partially narrowing a gap between the blower and an apparatus adjacent to the blower.

4. The dryer according to claim 1, further comprising:

an exhaust duct including the second airflow generator at a downstream end thereof in an exhaust direction of the second airflow, wherein the exhaust duct has an inclined top surface, a height of which increases toward the second airflow generator in the exhaust direction.

5. The dryer according to claim 4, wherein the exhaust duct includes a heater.

6. The dryer according to claim 4, wherein the exhaust duct includes a cooler.

7. The dryer according to claim 6, wherein the exhaust duct includes a receiver disposed below the lowest point of the inclined top surface of the exhaust duct.

8. The dryer according to claim 1, wherein the circuitry controls the first airflow generator and the second airflow generator to increase an outflow rate of the second airflow according to an increase in an inflow rate of the first airflow.

9. The dryer according to claim 1, wherein the circuitry controls the first airflow generator and the second airflow generator to control the exhaust amount of the second airflow to be equal to the blowing amount of the first airflow.

10. The dryer according to claim 1, wherein the circuitry controls the first airflow generator and the second airflow generator to control the exhaust amount of the second airflow to be larger than the blowing amount of the first airflow by a predetermined amount.

11. The dryer according to claim 1 further comprising:

a conveyor configured to convey a sheet;

wherein the blower configured to blow the first airflow to the sheet conveyed by the conveyor.

12. A printer comprising:

a liquid application device to apply a liquid onto a sheet; and the blower according to claim 1, the blower configured to blow the first airflow to the sheet onto which the liquid is applied by the liquid application device.

13. A blower comprising:

a first airflow generator configured to generate a first airflow to be blown to a sheet conveyed in the blower;

a second airflow generator configured to generate a second airflow to exhaust air in the blower outside the blower; and circuitry configured to control the first airflow generator and the second airflow generator to control a blowing amount of the first airflow and an exhaust amount of the second airflow according to a type of the sheet.

* * * * *